US008162034B2

(12) United States Patent
Bonner

(10) Patent No.: US 8,162,034 B2
(45) Date of Patent: Apr. 24, 2012

(54) THERMAL INNER TUBE

(76) Inventor: Michael R. Bonner, Rochester Hills, MI (US)

( * ) Notice: Subject to any disclaimer, the term of this patent is extended or adjusted under 35 U.S.C. 154(b) by 1363 days.

(21) Appl. No.: 10/566,639

(22) PCT Filed: Jul. 28, 2004

(86) PCT No.: PCT/US2004/024148

§ 371 (c)(1),
(2), (4) Date: Jan. 27, 2006

(87) PCT Pub. No.: WO2005/013329

PCT Pub. Date: Feb. 10, 2005

(65) Prior Publication Data

US 2006/0225865 A1 Oct. 12, 2006

Related U.S. Application Data

(60) Provisional application No. 60/490,470, filed on Jul. 28, 2003.

(51) Int. Cl.
*F28D 7/16* (2006.01)
*F16L 9/128* (2006.01)

(52) U.S. Cl. ..... 165/46; 165/70; 165/154; 165/164; 165/906; 138/172

(58) Field of Classification Search ..... 165/46, 165/154, 164, 177, 183, 906, 70; 138/172
See application file for complete search history.

(56) References Cited

U.S. PATENT DOCUMENTS

| | | | | | |
|---|---|---|---|---|---|
| 1,852,490 | A | * | 4/1932 | Sullivan | 165/156 |
| 2,611,585 | A | | 9/1952 | Boling | |
| 2,650,801 | A | * | 9/1953 | Collito | 165/164 |
| 2,707,095 | A | | 4/1955 | Parsons et al. | |
| 2,773,513 | A | | 12/1956 | Isenberg | |
| 2,915,292 | A | * | 12/1959 | Gross | 165/46 |
| 3,498,071 | A | | 3/1970 | Tremont | |
| 3,739,842 | A | | 6/1973 | Whalen | |
| 3,782,452 | A | | 1/1974 | Ceplon | |
| 3,904,394 | A | | 9/1975 | Prast | |
| 4,204,309 | A | * | 5/1980 | Lefrancois | 138/115 |
| 4,316,502 | A | | 2/1982 | Sanborn et al. | |
| 4,330,491 | A | | 5/1982 | Doshi et al. | |
| 4,410,012 | A | | 10/1983 | Redding et al. | |
| 4,411,307 | A | | 10/1983 | Ecker | |
| 4,678,027 | A | * | 7/1987 | Shirey et al. | 165/70 |
| 5,058,266 | A | * | 10/1991 | Knoll | 29/890.053 |
| 5,176,180 | A | | 1/1993 | Williams et al. | |
| 5,343,937 | A | * | 9/1994 | Gross | 165/70 |
| 5,909,766 | A | * | 6/1999 | Kobayashi et al. | 165/70 |
| 6,595,241 | B2 | | 7/2003 | Chen | |
| 7,694,717 | B2 | * | 4/2010 | Bonner et al. | 165/164 |

* cited by examiner

*Primary Examiner* — Leonard R Leo
(74) *Attorney, Agent, or Firm* — Young Basile

(57) ABSTRACT

An elongated structure (100) for the transmission of fluid-based compositions at non-ambient temperatures comprising a first conduit (130) for the transmission of a fluid-based composition, at least one flexible, elongated and inflatable temperature control conduit (110*a*, 110*b*) for the transmission of a temperature control fluid, the temperature control conduit (110*a*, 110*b*) having a relatively rigid elongated reinforcement member (116*a*, 116*b*); and elongated cover (140) holding said temperature control conduit (100*a*, 110*b*) in thermal communication with the first conduit (130).

20 Claims, 2 Drawing Sheets

THERMAL INNER TUBE

TECHNICAL FIELD

The present invention relates generally to processes and devices for temperature regulation of fluid conduits, and more particularly to such a device and method wherein at least one flexible, expansible profile is positioned in thermal contact with a fluid conduit, and heated or chilled fluid is passed therethrough to regulate the temperature of fluid carried therein.

BACKGROUND OF THE INVENTION

There are a wide variety of applications where heated or chilled fluid is delivered over a length of conduit such as a hose or pipe. Typical industrial applications include fluid coatings or adhesives that are applied at specific assembly or processing stations in a plant. The fluid may thus be stored in an area remote from the one or more dispensing stations. Many commonly used industrial compositions vary in viscosity with changes in temperature. For example, spray coating thickness, texture and cure time may all be affected by variations in the viscosity of the sprayed materials. Improved reliability and repeatability of dispense patterns and characteristics in industrial processes are a benefit of maintaining the temperature of the applied materials within a pre-selected range. It is generally preferred to perform the bulk temperature control at the point of introducing the fluid into the system, particularly where there are multiple application points. During delivery of the fluid to the application station, a change in fluid temperature can result if the ambient temperature varies from the initial control temperature. The temperature gradient increases as the difference between the ambient temperature and control temperature increases and as the length of the conduit increases.

Engineers have developed various means for achieving the desired temperature control. Once such design is a flexible cover assembly having thermal fluid transfer tubes attached or embedded therein. Such an assembly is known from U.S. Pat. No. 5,363,907 to Dunning et al. In Dunning, the cover is secured about a fluid supply conduit, and heated or chilled fluid is passed through the tubes. This design has met with significant success, however, the materials heretofore utilized in the assembly tend to be relatively insulative. These materials, typically in the form of elastomeric, cylindrical tubes are generally ineffective in transferring sufficient heat between the fluid supply conduit and the thermal transfer fluid to aggressively change the temperature of the fluid in the conduit.

An alternative design relates to coaxial hoses or pipes wherein a thermal transfer fluid is passed through the space between the outer diameter of an inner hose or pipe and the inner diameter of an outer hose or pipe. One such design is known from U.S. Pat. No. 5,287,913 to Dunning et al., herein incorporated by reference. Such a design has been demonstrated to be more effective in aggressively changing the temperature of fluid in the fluid supply conduit than tube-in-cover designs, however, the outer hose may have a tendency to buckle or kink, and therefore block fluid flow when the coaxial assembly is bent or flexed. Thus, the hose can collapse in certain high motion applications, potentially resulting in mixing of fluids from the inner and outer hoses, or breaking and spillage of thermal transfer fluid out of the outer hose. A related concern involves the necessity for securing the hose with clamps at various points. Where the coaxial hose is used to deliver fluid to a movable spray device, for example, it may be necessary to clamp the hose to portions of the movable device at various points. In order to avoid collapsing of the hose from clamping force, designers have typically used a relatively bulky, heavy duty, spiral wound reinforced hose.

SUMMARY OF THE INVENTION

It is an object of the present invention to provide an efficient, flexible device for supplying thermal transfer fluid along an exterior of a fluid conduit.

It is a further object of the present invention to provide a coaxial hose arrangement for temperature regulation of a fluid conduit having secondary containment for thermal transfer fluid used therein.

In accordance with these and other objects, the present invention comprises a fluid transfer profile that includes a flexible outer wall attached to an integral mounting tab and a relatively rigid, longitudinal reinforcing rib.

DETAILED DESCRIPTION OF PREFERRED EMBODIMENTS

Figure 1:
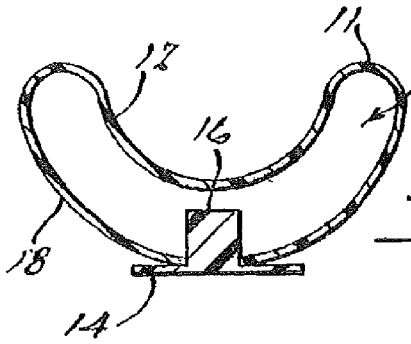
FIG. 1 illustrates an end view of a fluid transfer profile in accordance with a preferred embodiment of the present invention.

Referring to FIG. 1, there is shown an end view of a fluid transfer profile 10 according to a preferred constructed embodiment of the present invention. Profile 10 is an elongate, hollow member formed from a flexible, thermally conductive polymer or other rubber material, and is contemplated for use in temperature control of fluid conduits by positioning profile 10 in intimate, thermal contact therewith. A suitable thermal transfer fluid is passed through profile 10 to regulate the temperature of fluid passing through the fluid conduit. Propylene glycol or similar materials, various mineral and organic oils, water and other fluids, both compressible and incompressible, might be used, depending on the heat transfer needs of the system, materials, and operating temperatures. Where greater or lesser temperature adjustment of the subject pipe is desired, the temperature and/or flow rate of fluid in the profile 10 can be adjusted.

The preferably arcuate inner surface 12 of profile 10 assists in optimizing the heat transfer properties of the system by maximizing physical contact between profile 10 and the subject conduit or pipe, which is typically substantially cylindrical. The cross sectional geometry of profile 10 may be tailored for particular applications. For instance, profile 10 might be fashioned to have a relatively greater area of surface contact with a fluid conduit than the examples in the drawing Figures, and a correspondingly flatter cross section. Similarly, larger or smaller profiles can be used to increase or decrease the fluid flow capacity, or the effective area of surface contact with the fluid conduit, depending on system requirements. The wall thickness of the profile along its side of contact with the fluid conduit can also be adjusted to provide varying degrees of thermal conductivity. A mounting tab 14 is preferably attached to an outer surface 18 of profile 10, and is attached to a reinforcing rib 16 that extends longitudinally through a fluid transfer passageway 20. Various methods may be employed in manufacturing profile 10 such as extrusion, molding, heat-sealing, embossing, etc. For example, profile 10 can be extruded as a single piece wherein mounting tab 14 and reinforcing rib 16 are formed integrally with relatively thin walls 11 of extrudate defining passage 20. Alternatively, the walls 11 can be formed separately from tab 14 and rib 16, and the components heat sealed or otherwise attached in any suitable manner. Although rib 16, tab 14 and walls 11 are all preferably extruded from a substantially homogeneous material, the components might be made from differing materials for certain applications. For example, reinforcing inserts could be molded into either or both of tab 14 and rib 16 to enhance the strength of the assembly. Further, materials having relatively greater or lesser thermal conductivity can be used to form different parts of profile 10. For example, a material having a relatively greater thermal conductivity might be used to form the portions of profile 10 that contact the fluid conduit, whereas a relatively more insulative material might be used for portions of profile 10 positioned opposite the fluid conduit. All the components of the present invention are manufactured from known materials and by known processes.

Figure 2:
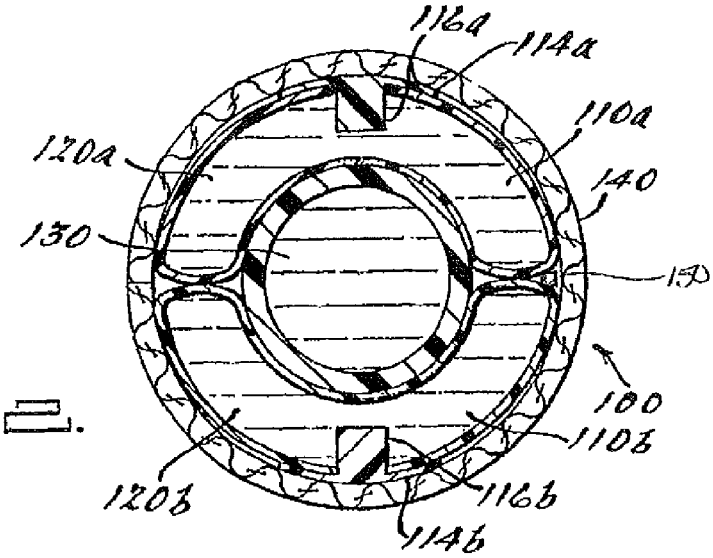
FIG. 2 illustrates a cross section of a set of fluid transfer profiles positioned in a coaxial hose assembly in accordance with the present invention.

Referring to FIG. 2, there is shown an embodiment of the present invention 100 wherein a set of two profiles 110*a* and 110*b* are positioned in a coaxial hose assembly comprising inner and outer hoses 130 and 140. In particular, the profiles 110*a* and 110*b* are positioned between the outside diameter of the inner hose 130 and the inside diameter of the outer hose 140. It should be appreciated that "hose" encompasses any fluid transfer conduit, and the descriptions herein with respect to hoses 130 and 140 are equally applicable to other, similar items such as conventional pipes. As illustrated in FIG. 2, a pair of elongate reinforcing ribs 116*a* and 116*b* extend from a pair of mounting tabs 114*a* and 114*b* into fluid passages 120*a* and 120*b*. Ribs 116*a* and 116*b* assist in preventing walls 111 from collapsing (kinking) when coaxial hose assembly 100 is bent, and preferably extend substantially along the entire length of the fluid passages 120*a* and 120*b*. Mounting tabs 114*a* and 114*b* are preferably flexible, and may flex to conform to an inner contour of outer hose 140. In a preferred embodiment, flexible mounting tabs 114*a* and 114*b* add flexible support to the assembly. The added support from mounting tabs 114*a* and 114*b*, and the reduced need for a reinforced outer hose (since it does not directly carry the thermal transfer fluid) allow outer hose 140 to be made without an integral reinforcement such as a longitudinal metal coil. In addition, reinforcing ribs 116*a* and 116*b* prevent collapse of the fluid passage when the assembly is clamped, further reducing the need for sturdiness and thickness of outer hose 140, further described below. Further still, because outer hose 140 can be made from lighter weight, more flexible, and less expensive materials than many earlier designs, the assembly is more flexible overall. Although two profiles are utilized in the FIG. 2 embodiment, the present invention is not limited to such a design, and a greater number of profiles might be used for other applications. The flow of thermal transfer fluid through the profiles is preferably opposite, i.e. one of profiles 110*a* and 110*b* passes fluid in the same direction as the fluid transfer conduit or inner hose 130, while the other of profiles 110*a* or 110*b* passes fluid in a direction opposite to that of inner hose 130. Where a different number of profiles is used, they may be used alternately as fluid supply and return paths.

Figure 5:
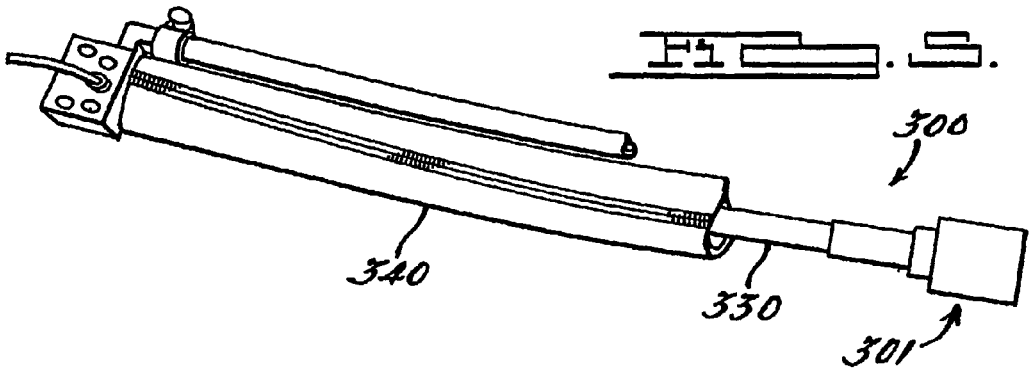
FIG. 5 illustrates a coaxial hose assembly in accordance with a known system.

In a typical coaxial hose assembly according to the present invention, such as assembly 100, machined, molded, or otherwise formed blocks are provided at opposite ends of the section of fluid conduit that is to be temperature-regulated. The blocks provide a manifold type arrangement whereby the thermal transfer fluid can be directed into its appropriate supply or return path(s), in a manner known in the art. Referring to FIG. 5, there is shown a coaxial hose assembly 300 in accordance with the prior art, illustrating a terminal block 301 for directing thermal transfer fluid through an outer hose 340 as well as directing a fluid supply through an inner hose 330.

In alternative embodiments, sensing probes 150, known in the art, may be inserted into gaps between the profiles and the outer hose 140. If thermal transfer fluid escapes from passages 120*a* and 120*b*, changes in the capacitance, resistance, pressure, etc., of the probes can be used to generate an electrical signal that notifies a control system or a technician that a potential spill and or system-down condition may be imminent. Outer hose 140 also serves as a secondary containment barrier for the thermal transfer fluid. This built-in spill-safe feature further reduces the risk of damage to equipment or product, as the outer hose can contain the thermal transfer fluid about the inner hose 130 for a period of time sufficient to allow proper shutdown of the system. For example, utilizing sensors to identify a potential leak problem before temperature regulation is compromised can allow the fluid supply conduits (inner hose 130) to be drained of material in advance of cooling in the system sufficient to allow solidification of material therein. Similarly, the early warning capability of the present design in conjunction with secondary containment could prevent chilled volatile compositions from arriving at their application points at too high a temperature for safe application. Thus, the present design provides significantly reduced risks of spills, system damage, and can even provide for safer system operation. These advantages are not provided by earlier designs wherein the thermal transfer fluid is carried directly by an outer hose.

Figure 4:
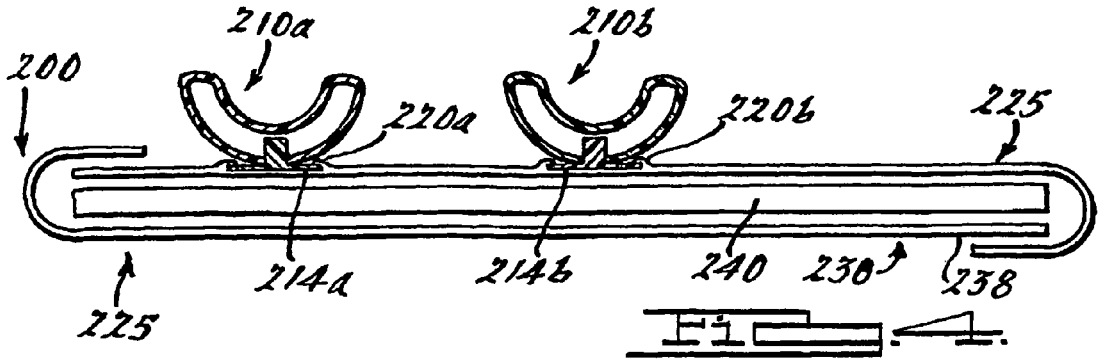
FIG. 4 illustrates a cross section of an insulated cover assembly wherein a set of fluid transfer profiles according to the present invention are mounted.

Turning to FIG. 4, there is shown a cover assembly 200 that is yet another embodiment of the present invention. In assembly 200, a set of profiles 210*a* and 210*b* are retained in pockets or sleeves 220*a* and 220*b* that are attached to a flexible cover 230. Cover assembly 200 is primarily contemplated for use in established systems that require, for example, supplementary heating, however, cover assembly 200 might also be incorporated as part of an original system design. Cover 230 is preferably formed from a flexible fabric that can be wrapped around the pipe that is to be heated. Although conventional fabrics are preferred for most applications, for instance woven polyesters, nylons or other common polymers, where the temperatures encountered are relatively great, highly heat-resistance polymers or other suitable, non-polymeric materials may be used. Because cover 230 is preferably formed from multiple layers of material, various insulating layers may be incorporated therein, both to enhance the heat-resistance of the cover material itself and to improve the temperature control capabilities of the cover assembly. In one preferred embodiment, one or more layers of flexible insulation material, for instance fiberglass, is/are affixed between two layers of durable polymeric fabric. The layers can be glued, riveted, ultrasonically or thermally welded, or attached by any other known means. Most preferably, the layers are sewn together. Various combinations of insulating; protective or decorative materials may be used.

Figure 3:
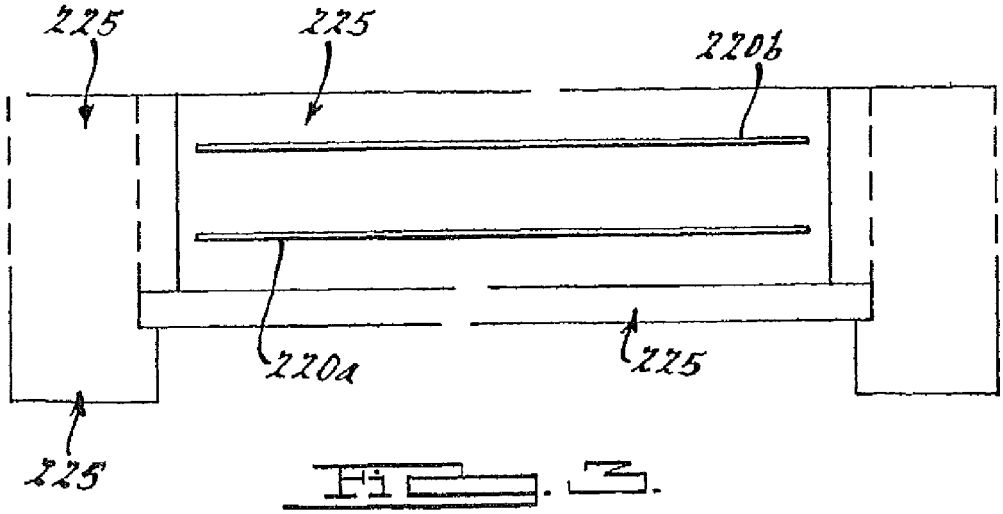
FIG. 3 is an elevational view of an insulated cover assembly for use with fluid transfer profiles in accordance with the present invention.

Pockets 220*a* and 220*b* may comprise longitudinal sleeves into which mounting tabs 214*a* and 214*b* are slid, or they may comprise, for example, discrete sets of clips or other retainers that overlap mounting tabs 214*a* and 214*b* when positioned therein. Further still, the means for attaching profiles 210*a* and 210*b* could be any suitable attachment, for instance, Velcro®, adhesives, stitches, etc. might be used without departing from the scope of the present invention. In a preferred embodiment, cover 230 is wrapped around a fluid transfer conduit, bringing profiles 210*a* and 210*b* into thermal contact therewith. Velcro® strips, identified with numeral 225 in FIG. 4, snaps, hooks, a zipper or some other means may be used for securing cover 230 about the subject conduit. Because it is desirable to effectively thermally isolate the environment within the wrapped cover from ambient, securing means are preferred which substantially block air exchange along the attached edges of the cover 230. The dimensions of cover assembly 200 are variable, and will be greater or lesser depending on the length and diameter of the pipe whose temperature is to be adjusted. Similar to the foregoing embodiments, although two profiles are preferably used, other applications may call for a different number of profiles, and a correspondingly different number of pockets. In a preferred embodiment, cover 230 comprises an outer fabric layer 238, and an inner, insulating layer 240. Thermal transfer fluid passed through profiles 210*a* and 210*b* thus changes the temperature of the air and fabric between the insulative layer 240 and the fluid transfer conduit. The heated or chilled air and fabric provide extra insulation around the fluid transfer conduit. Further, the flexible fabric cover renders assembly 200 well suited to high motion/high angle applications. FIG. 3 illustrates a schematic view of a fabric profile cover assembly 230 similar to the cover of FIG. 4. Identical numerals in FIGS. 3 and 4 denote similar features. While a preferred embodiment of the present invention has been described in which a flexible, fabric cover is utilized, it should be appreciated that alternative embodiments are contemplated. For example, a relatively rigid, multi-piece hinged cover might be substituted so long as the profiles can be brought into intimate contact with the pipe when the cover is engaged therewith.

A typical installation process utilizing a cover assembly according to the present invention begins by selecting an appropriately sized and designed cover assembly. Cover assemblies according to the present invention may be any length or size, or have essentially any number of fluid transfer profiles, limited only by the length and diameter of the fluid conduit to be fitted, and the thermal exchange requirements of the system. Once the desired cover assembly is selected, the fluid conduit surface is prepared. This may include cleaning or otherwise treating the pipe surface to ensure the most effective transfer of thermal energy. Before applying the cover assembly, a thermal transfer material such as thermal transfer grease may be applied longitudinally along the arcuate surfaces of the profiles or the fluid transfer conduit. There are many such materials known in the art, and various greases, pastes, creams, and gels are readily commercially available. Further still, there are numerous dry, thermally conductive foams and tapes known in the art that may be applied, for example with a thermally conductive adhesive. Likewise, a low durometer thermally conductive polymer may be introduced during the fabrication phase of the profile and extruded, molded, heat fused, or otherwise bonded to the surface. The cover is wrapped circumferentially around the conduit and secured, preferably bringing the profiles into secure contact with the conduit, with the layer of thermal gap filler positioned between the conduit and profiles. Once secured, the profiles can be connected to the thermal fluid circulation system in any known fashion.

Figure 6:
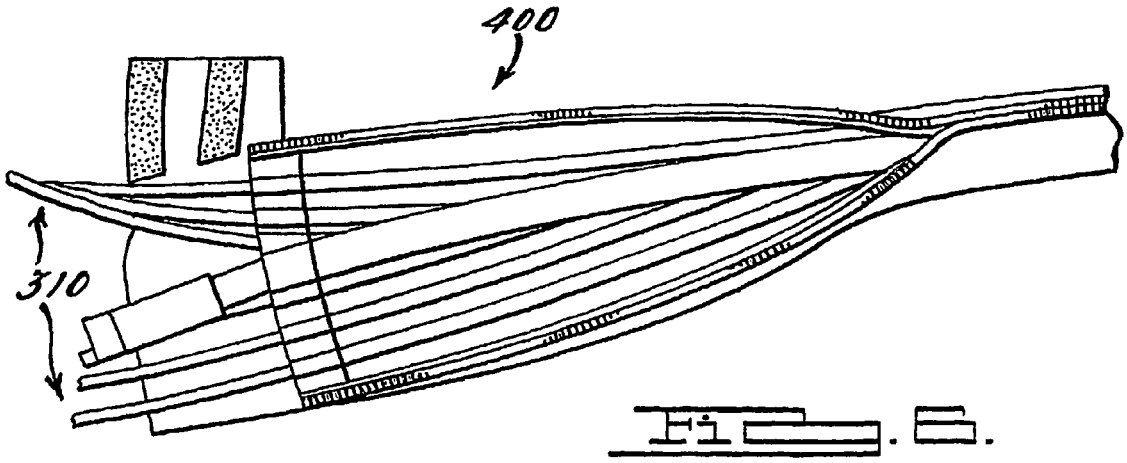
FIG. 6 illustrates a cover assembly in accordance with a known system.

Referring to FIG. 6, there is shown an exemplary known cover assembly 400. Cover assembly 400 provides a plurality of substantially cylindrical tubes 310 that are attached to a flexible cover 338. Cover 338 is wrapped and secured around a fluid conduit, allowing heated or chilled fluid passed through tubes 310 to regulate the temperature of the conduit and fluid therein. Referring to the drawing Figures generally, profiles used in the practice of the inventive embodiments described herein, such as profile 10 are preferably flexible, and may therefore find particular application in environments where the fluid transfer conduit or hose whose temperature is to be regulated is flexible. For example, profile assemblies according to the present invention might be used to regulate the temperature of fluid applied to a part or a mold via an industrial sprayer with movable spray elements. In such a device, temperature control of the delivered fluid can be carried out in spite of the need to move the fluid delivery device, as the flexible profile can be maintained substantially in thermal contact with walls of the fluid conduit even when moved to varying positions.

The flexible nature of profile 10 allows thermal transfer fluid passed therethrough to "inflate" the profile, whereby the profile is expanded to fill gaps between the coaxial hoses, or in the case of the cover assembly, gaps between the fluid transfer conduit and the cover. Stated another way, the walls 11 of the fluid transfer passage 20 expand when thermal transfer fluid is passed into profile 10. Expansion of profile 10 enhances heat transfer between the fluid supply conduit and the thermal transfer fluid by enhancing the surface to surface contact between profile 10 and the subject fluid supply conduit.

Returning to FIG. 2, illustrating coaxial hose assembly 100, thermal transfer fluid supplied to passages 120*a* and 120*b* provides outward pressure against the inner diameter of second hose 140. Similar to an inflating inner tube, the expansive outer pressure imparts additional rigidity to the assembly, without sacrificing overall flexibility. Thus, a larger clamping force than would otherwise be possible can be provided to assembly 100 without concerns of collapsing outer hose 140. Varying degrees of fluid pressure may be provided to profiles 110*a* and 110*b*, providing relatively greater or lesser rigidity, depending on the desired rigidity of assembly 100. This characteristic is rather like increasing the gas pressure in an inflatable inner tube, wherein the inner tube increases in strength and rigidity as the internal pressure is increased. Because outer hose 140 is relatively rigid, it resists expansion as the fluid pressure in profile 110 is increased, gaining rigidity with increasing internal pressure.

The blocks for directing fluid that are preferably utilized in conjunction with the present invention (not shown) are preferably designed such that they can accommodate either of the above-described coaxial hose and cover assembly embodiments. These may be fabricated from a metal or plastic material such as aluminum, carbon or stainless steel, titanium, Delrin, PVC, polypropylene or any other material which may be formed to achieve geometries that are suitable to contain the pressures of a given system. These may be machined, molded, cast, or otherwise formed to create the various passages required to route the various fluids properly through the system. These blocks may also be fabricated with a port designed to allow placement of a temperature sensing probe directly into the path of the material to be temperature controlled to allow direct monitoring of the material's temperature for relaying to a controller, display, or any other appropriate device. Furthermore, these may be designed to include sensing probes as previously discussed that extend into the annular space between the inner hose, pipe or tube and outer layers for the purpose of sensing leakage of a fluid into that space. This feature may be in the form of a connector to which remote sensors may be attached such that the signal may be passed to the outside of the system and relayed to a host system. These sensors may be a point type, or may extend through the length of the assembly so as to detect leakage at the earliest possible opportunity.

The present description is for illustrative purposes only, and should not be construed to limit the breadth of the present invention in any way. Thus, those skilled in the art will appreciate that various modifications might be made to the presently disclosed embodiments without departing from the intended spirit and scope of the present invention.

The invention claimed is:

1. An elongated structure for the transmission of fluid-based compositions at non-ambient temperatures comprising:

a conduit for the transmission of a fluid-based composition;

at least two flexible elongated temperature control conduits for the transmission of a temperature control fluid, each of said temperature control conduits having a pair of generally opposing walls, wherein a first wall is positioned radially outward relative to said transmission conduit, a second wall is positioned radially inward relative to said transmission conduit, a relatively rigid elongated reinforcement member positioned in one of the first and second walls and projecting inwardly into the temperature control conduit, and a tab projecting outward from the wall in which the reinforcement member is positioned, wherein said at least two flexible elongated temperature control are composed of a flexible polymeric material; and an elongated cover holding said elongated temperature control conduits in thermal communication with said transmission conduit, wherein the cover has an outwardly oriented surface and an opposed inwardly oriented surface disposed radially inward thereof, and at least two elongated pockets defined on the inwardly oriented surface of the elongated cover, each pockets containing the projecting tabs of the associated flexible elongated temperature control conduit, the pockets positioned on the inward surface such that the flexible elongated temperature control conduits are positioned in spaced relationship to one another, the outwardly oriented surface of the cover in radial spaced relationship to the first conduit and defining a cavity spaced between the cover and the first conduit, wherein the flexible elongated conduits are positioned in said cavity, wherein said flexible elongated temperature control conduits are positioned between the transmission conduit and the elongated cover.

2. The structure of claim 1 wherein said elongated cover comprises a fluid-tight outer conduit enclosing said temperature control conduit and said conduit.

3. The structure of claim 2 wherein said outer conduit contains no integral structural reinforcement.

4. The structure of claim 2 wherein said outer conduit includes no superficial structural reinforcement.

5. The structure of claim 1 wherein said reinforcement member extends radially with respect to said conduit and wherein said tab is positioned on the first wall of the elongated conduit and projects outward from the first wall perpendicularly with respect to said reinforcement member.

6. The structure of claim 5 wherein said temperature control conduit has a pair of generally opposing walls, a first wall radially outward relative to said transmission conduit and a second wall radially inward relative to said conduit.

7. The structure of claim 5 wherein tab has a configuration that is generally planar.

8. The structure of claim 7 wherein said reinforcement member comprises a radially extending body and said reinforcement tab extends circumferentially of said body.

9. The structure of claim 1 further comprising a sensor within said cover for detecting the pressure of said temperature control fluid outside of said temperature control conduit.

10. The structure of claim 1 wherein a pair of polymeric temperature control conduits are held on generally opposing sides of said transmission conduit and wherein the temperature control conduits contact each other when in position relative to the transmission conduit.

11. The structure of claim 1 wherein said temperature control conduit is inflatable by the introduction of said temperature control fluid.

12. The structure of claim 1 wherein the first wall of said temperature control conduit is arcuate and radially outward relative to said transmission conduit and the -second wall is radially inward relative to said transmission conduit.

13. The structure of claim 1 wherein the first wall of the flexible elongated temperature control conduit is radially outward relative to said transmission conduit and the second wall is arcuate and is radially inward relative to said transmission conduit.

14. An assembly for providing temperature control for a fluid within a subject conduit conveying fluid in a fluid conveying direction, said assembly comprising:

an elongated flexible cover, at least one temperature control conduit having a pair of opposed walls with one of said walls disposed proximate to the subject conduit and another of the pair disposed a spaced distance therefrom, a relatively rigid inner rib extending along substantially the length of said temperature control conduit, and a tab projecting outwardly from the conduit at a location proximate to the inner rib, said temperature control conduit disposed within said cover and configured to convey temperature control fluid in a temperature control fluid direction fluid, wherein the tab is connected to the cover; and a releasable fastener to hold said cover around said subject conduit such that said temperature control conduit is in thermal communication with said subject conduit and the temperature control fluid direction and the subject fluid conveying direction are parallel to each other;

wherein said elongated cover has at least one elongated pocket for receiving said tab configured on said temperature control conduit for holding said temperature control conduit relative to said elongated cover.

15. The assembly of claim 14 wherein said elongated cover comprises a flexible homogenous material.

16. The assembly of claim 14 wherein said cover contains no integral structural reinforcement.

17. The assembly of claim 14 wherein said tab is an elongated planar member.

18. The assembly of claim 17 wherein said rib comprises a radially extending body and said reinforcement tab extends circumferentially of said body.

19. The assembly of claim 14 further comprising a sensor within said cover for detecting the pressure of said temperature control fluid outside of said temperature control conduit.

20. The assembly of claim 14 wherein said temperature control conduit has a pair of generally opposing walls, a first wall and an arcuate outwardly curving second wall.

* * * * *